US006053699A

United States Patent [19]

Turnquist et al.

[11] Patent Number: 6,053,699

[45] Date of Patent: Apr. 25, 2000

[54] STEAM TURBINE HAVING A BRUSH SEAL ASSEMBLY

[75] Inventors: Norman Arnold Turnquist, Cobleskill; Osman Saim Dinc, Troy; George Ernest Reluzco, Schenectady; Daniel Richard Cornell, Clifton Park; Robert Harold Cromer, Johnstown; Kenneth Elmer Robbins, Burnt Hills; Christopher Edward Wolfe, Niskayuna, all of N.Y.

[73] Assignee: General Electric Company, Schenectady, N.Y.

[21] Appl. No.: 09/122,960

[22] Filed: Jul. 27, 1998

[51] Int. Cl.[7] ..... F01D 11/00

[52] U.S. Cl. ..... 415/231; 415/174.2; 415/174.5; 415/230

[58] Field of Search ..... 415/111, 112, 415/113, 174.2, 174.5, 230, 231; 277/355

[56] References Cited

U.S. PATENT DOCUMENTS

| | | | |
|---|---|---|---|
| 885,032 | 4/1908 | Ferranti | 277/355 |
| 1,757,212 | 5/1930 | Parsons et al. | 415/111 |
| 3,778,182 | 12/1973 | Hohn et al. | 415/113 |
| 5,613,829 | 3/1997 | Wolfe et al. . | |
| 5,630,590 | 5/1997 | Bouchard et al. . | |
| 5,678,898 | 10/1997 | Bagepalli et al. . | |

OTHER PUBLICATIONS

Application entitled, "Anti–Hysteresis Brush Seal", Serial No. 08/928,114; filed Sep. 12, 1997.

Application entitled, "Brush Seal for High–Pressure Rotor Applications", Serial No. 08/967,640; filed Nov. 10, 1997.

Application entitled, "Brush Seal for Use on Bumpy Rotating Surfaces", Serial No. 08/950,082; filed Oct. 14, 1997.

Application entitled, "Brush Seal for Use on Rough Rotating Surfaces", Serial No. 08/942,887, filed Oct. 2, 1997.

*Primary Examiner*—Christopher Verdier

*Attorney, Agent, or Firm*—Douglas E. Erickson; Marvin Snyder

[57] ABSTRACT

A steam turbine having a shaft and a first (e.g., high-pressure) turbine section. A first embodiment also includes a first bearing longitudinally spaced apart from the first turbine section and further includes a first brush-seal assembly, having bristles, longitudinally positioned between the first turbine section and the first bearing and radially positioned proximate the shaft. The steam turbine is devoid of any backup seal to the bristles. In a second embodiment, a second brush seal assembly is positioned between the first and second (e.g., intermediate-pressure) turbine sections which lack any intervening bearing.

15 Claims, 3 Drawing Sheets

STEAM TURBINE HAVING A BRUSH SEAL ASSEMBLY

FIELD OF THE INVENTION

The present invention relates generally to steam turbines, and more particularly to a steam turbine having a steam-path seal assembly.

BACKGROUND OF THE INVENTION

A steam turbine has a steam path which typically includes, in serial-flow relationship, a steam inlet, a turbine, and a steam outlet. A gas turbine has a gas path which typically includes, in serial-flow relationship, an air intake (or inlet), a compressor, a combustor, a turbine, and a gas outlet (or exhaust nozzle). Gas or steam leakage, either out of the gas or steam path or into the gas or steam path, from an area of higher pressure to an area of lower pressure, is generally undesirable. For example, gas-path leakage in the turbine or compressor area of a gas turbine, between the rotating rotor shaft of the turbine or compressor and the circumferentially surrounding turbine or compressor casing, will lower the efficiency of the gas turbine leading to increased fuel costs. Also, steam-path leakage in the turbine area of a steam turbine, between the rotating shaft of the turbine and the circumferentially surrounding casing, will lower the efficiency of the steam turbine leading to increased fuel costs.

The turbine portion of a steam turbine typically includes a high-pressure turbine section, perhaps an intermediate-pressure turbine section, and a low-pressure turbine section each having rotatable steam-turbine blades fixedly attached to, and radially extending from, a steam-turbine shaft which is rotatably supported by bearings. The bearings usually are located longitudinally outward from the high and low-pressure turbine sections and longitudinally between the high and intermediate-pressure turbine sections. Usually the steam pressure drop through a high-pressure or an intermediate-pressure turbine section is at least generally 2,000 kPa (kiloPascals), and the difference in pressure of the steam entering the high and intermediate-pressure turbine sections is at least generally 600 kPa. It is noted that the steam exiting the high-pressure turbine section normally is reheated by the boiler before entering the intermediate-pressure turbine section and that the "steam" exiting the low-pressure turbine section enters a condenser before being directed to the boiler, as is known to the artisan.

Labyrinth seals have been used to minimize steam-path leakage between the high-pressure turbine section and its longitudinally-outward bearing, between the low-pressure turbine section and its longitudinally-outward bearing, and between the high and intermediate-pressure turbine sections. Such labyrinth seals consist of longitudinally spaced-apart rows of labyrinth seal teeth. Many rows of teeth are needed to seal against the high-pressure differentials found in a typical steam turbine, and this has contributed to the impressive longitudinal length (sometimes over fifteen meters) of a standard steam turbine used by power utilities to turn a generator for the production of electricity. Such length has required extra bearings to support the steam-turbine rotor.

It is noted that brush seals are used to minimize leakage through a gap between two components, wherein such leakage is from a higher pressure area to a lower pressure area. Brush seals have been used, or their use proposed, in rotating machinery. Such use or proposed use includes, but is not limited to, turbomachinery including steam turbines and gas turbines used for power generation and gas turbines used for aircraft and marine propulsion. It is noted that brush seals minimize the leakage of steam in steam turbines and minimize the leakage of compressed air or combustion gases in gas turbines.

The brush seals usually have wire or ceramic bristles conventionally welded or otherwise affixed to a backing plate. To improve performance, such brush seals typically align their wire bristles to contact the rotating rotor shaft at an angle between generally forty-five and generally sixty degrees with respect to a radius line from the center of the rotor to the point of bristle contact. For high pressure applications, a seal plate is positioned against the seal bristles on the downstream side (i.e., lower-pressure side) of the brush seal. Brush seals do a better sealing job than labyrinth seals, as can be appreciated by the artisan. However, all known steam turbines or steam turbine designs which rely on a brush seal assembly between turbine sections or between a turbine section and a bearing also rely on a standard labyrinth seal which acts as a backup seal for the brush seal assembly.

SUMMARY OF THE INVENTION

In a first preferred embodiment, the steam turbine of the invention includes a steam-turbine shaft, a first turbine section, a first bearing, and a first brush-seal assembly. The first turbine section has rotatable steam-turbine blades fixedly attached to, and radially extending from, the shaft. The first bearing is longitudinally spaced apart from the first turbine section and rotatably supports the shaft. The first brush-seal assembly is longitudinally positioned between the first turbine section and the first bearing and is radially positioned proximate the shaft. The first brush seal assembly includes bristles, and the steam turbine is devoid of any backup seal to the bristles of the first brush seal assembly.

In a second preferred embodiment, the steam turbine of the invention includes a steam-turbine shaft, a first turbine section, a second turbine section, and a second brush-seal assembly. The first and second turbine sections each have rotatable steam-turbine blades fixedly attached to, and radially extending from, the shaft. The second turbine section is longitudinally spaced apart from the first turbine section without an intervening bearing. Steam enters the second turbine section at a different pressure than the steam which enters the first turbine section. The second brush-seal assembly is longitudinally positioned between the first and second turbine sections and is radially positioned proximate the shaft. The second brush seal assembly includes bristles, and the steam turbine is devoid of any backup seal to the bristles of the second brush seal assembly.

In a third preferred embodiment, the steam turbine of the invention combines the features of the first and second preferred embodiments. Preferably, the first brush-seal assembly is the only seal longitudinally positioned between the first turbine section and the first bearing and radially positioned proximate the shaft, and the bristles of the first brush-seal assembly provide generally one-hundred-percent of the steam-sealing capability of the first brush seal assembly. Likewise, it is preferred that the second brush-seal assembly is the only seal longitudinally positioned between the first and second turbine sections and radially positioned proximate the shaft, and the bristles of the second brush-seal assembly provide generally one-hundred-percent of the steam-sealing capability of the second brush seal assembly.

Several benefits and advantages are derived from the invention. The bristles of the brush seal assemblies provide better steam-sealing capability than do the teeth of a labyrinth seal assembly. Also, and most importantly, the use of brush seal bristles alone, without any labyrinth backup seal, will dramatically shorten the longitudinal length of the steam turbine. With Applicants' invention, the length of a typical steam turbine can be reduced from generally fifteen meters to generally nine meters, and a bearing supporting the steam-turbine shaft can be removed that would otherwise be located between the high and intermediate pressure turbine sections.

DETAILED DESCRIPTION OF THE INVENTION

Figure 1:
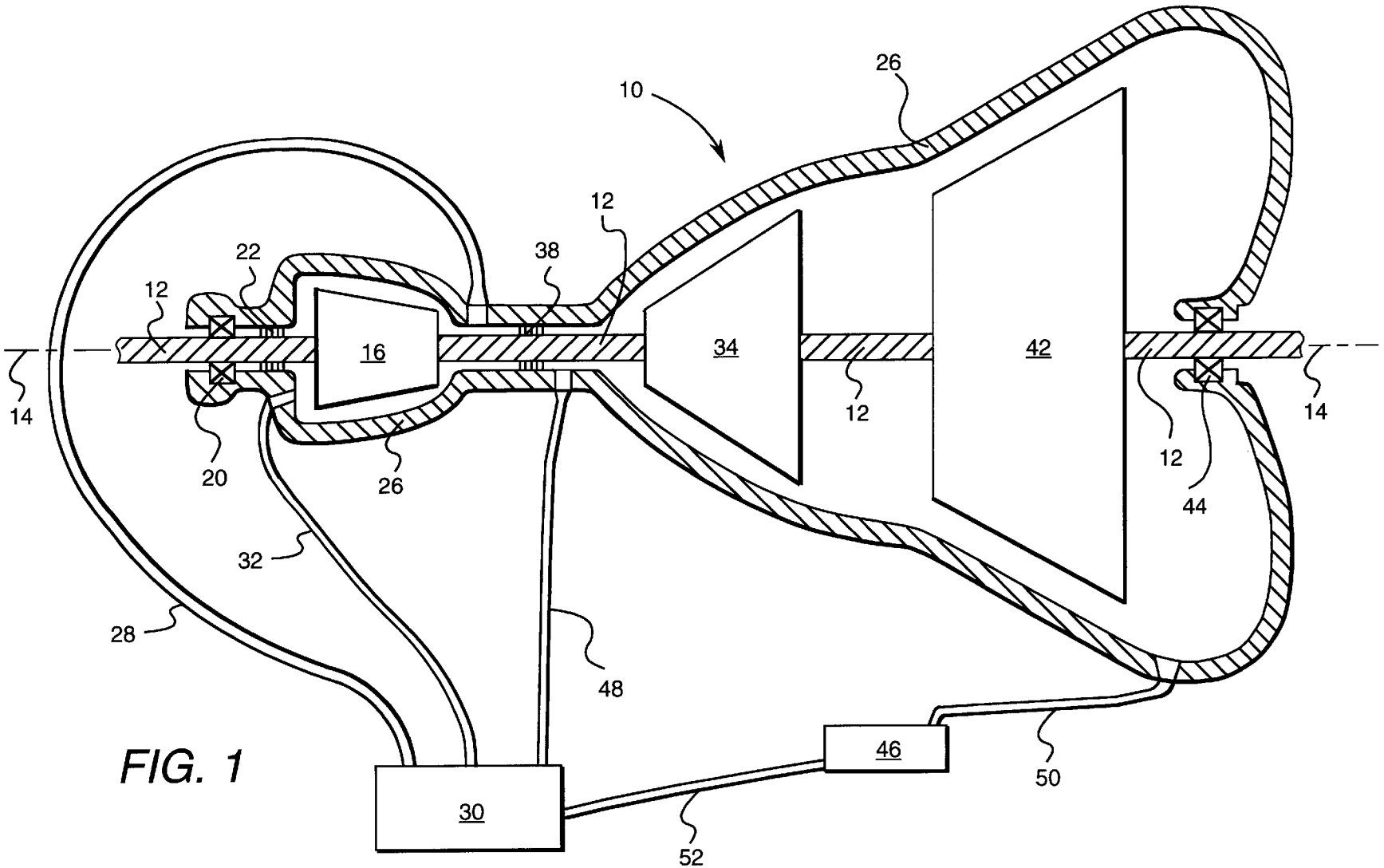
FIG. 1 is a schematic, partially cross-sectional view of a preferred enablement of the steam turbine of the present invention.
Figure 2:
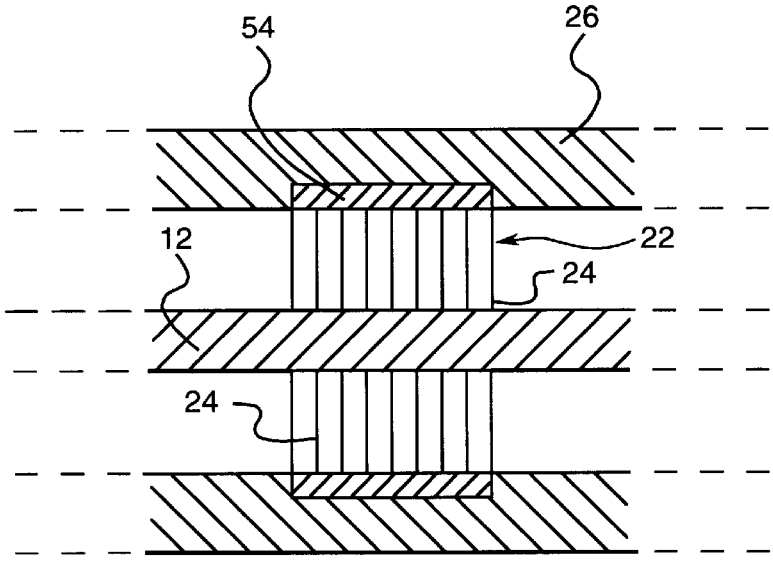
FIG. 2 is an enlarged view of a portion of the steam turbine of FIG. 1 showing the first brush seal assembly and surrounding area.
Figure 3:
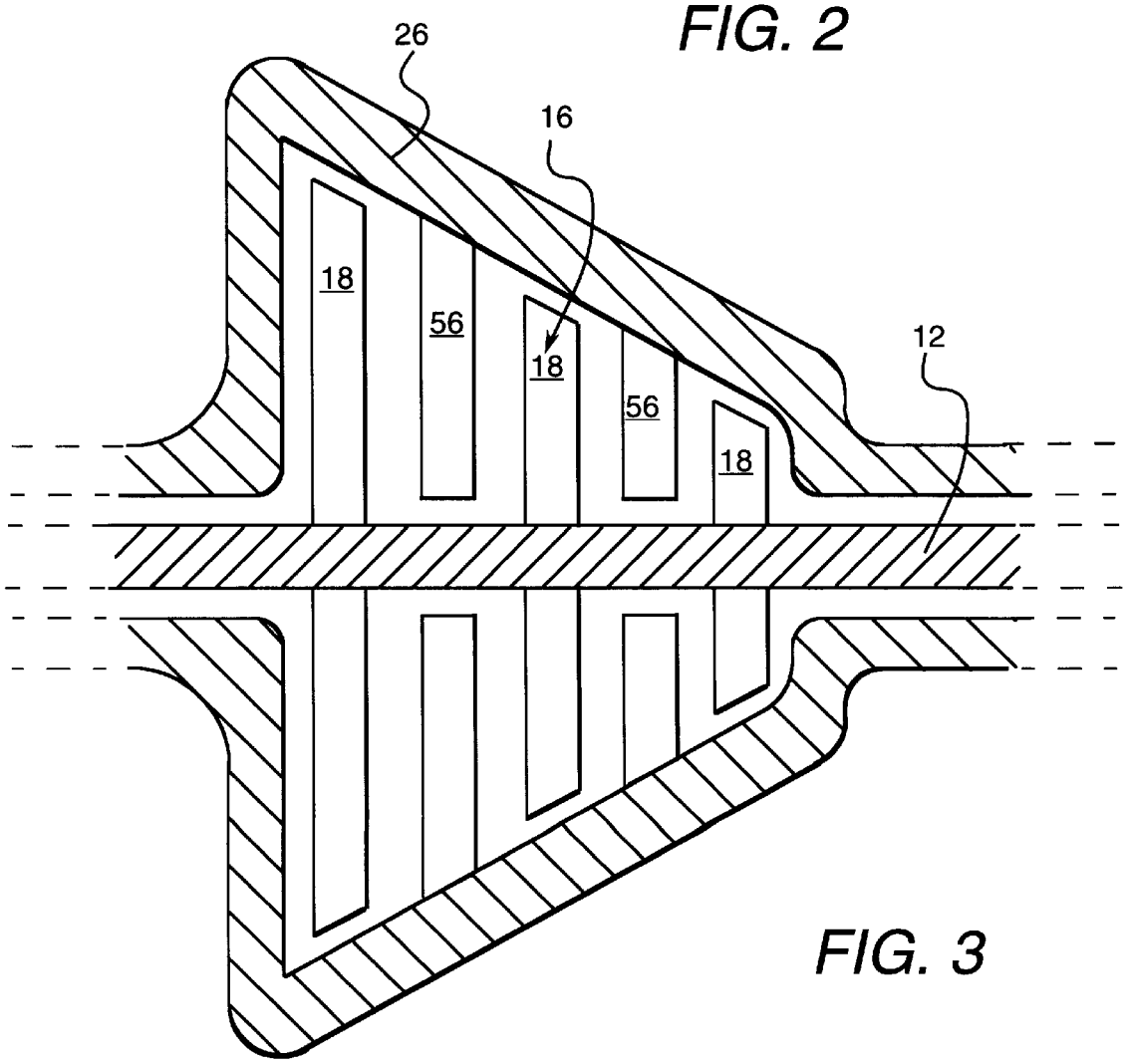
FIG. 3 is an enlarged view of a portion of the steam turbine of FIG. 1 showing the first turbine section (i.e., the high-pressure turbine section) and surrounding area.

Referring now to the drawings, FIGS. 1–3 schematically show a preferred enablement of the steam turbine 10 of the present invention. In a first preferred embodiment of the invention, the steam turbine 10 includes a steam-turbine shaft 12 having a generally longitudinally-extending axis 14. The shaft 12 may comprise a single monolithic shaft or may comprise two or more shaft sections which are affixed together to create the overall shaft 12. It is understood, for the purpose of describing the present invention, that the term "shaft" includes "disc" or "wheel" and the like.

The steam turbine 10 also includes a first turbine section 16 having rotatable steam-turbine blades 18 fixedly attached to, and radially extending from, the shaft 12. The blades 18 are also known as buckets or airfoils. The terminology "fixedly attached to" means the blades 18 turn with the shaft 12. It is understood that the blades 18 may be detached from the shaft 12 for inspection, repair, replacement, and the like. Typically, the blades 18 extend radially outward from the shaft 12. Steam enters the first turbine section 16 at a first pressure. Preferably, the first turbine section 16 is a high-pressure turbine section wherein the steam pressure drop through the first turbine section 16 is at least generally 2,000 kPa (kiloPascals). In a typical steam turbine design, the first pressure is between generally 8,300 kPa and generally 24,000 kPa, and the pressure of the steam exiting the first turbine section 16 is generally 4,000 kPa.

The steam turbine 10 additionally includes a first bearing 20 longitudinally spaced apart from the first turbine section 16 and rotatably supporting the shaft 12. Preferably, the first bearing 20 is a combination journal and thrust bearing as can be appreciated by those skilled in the art. A tapered land or tilting pad bearing is typically used.

The steam turbine 10 moreover includes a first brush-seal assembly 22 longitudinally disposed between the first turbine section 16 and the first bearing 20 and radially disposed proximate the shaft 12. The first brush seal assembly 22 includes a plurality of bristles 24 (most clearly shown in FIG. 2) having tips which preferably generally contact the shaft 12. The steam turbine 10 is devoid of any backup seal (such as, but not limited to, a labyrinth seal) to the bristles 24 of the first brush seal assembly 22. For the purpose of describing the present invention, a steam turbine is said to be devoid of any backup seal to the bristles of a brush seal assembly longitudinally disposed between a turbine section and a bearing if the steam-leakage rate between the turbine section and the bearing would at least double if all of the bristles of the brush seal assembly were removed. It is understood that the bristles 24 of the first brush seal assembly 22 may comprise one or more packets of bristles and that such packets may be located only in one area or may be longitudinally spaced apart from each other so as to be positioned at discrete sealing locations. It is further understood that the first brush-seal assembly 22 may contain, in addition to the bristles 24, other types of seals including, without limitation, labyrinth seals but only if the other types of seals are being used as primary (and not backup) seals. However, it is preferred that the bristles 24 of the first brush seal assembly 22 provide at least generally ninety-percent of the total steam-sealing capability of all seals taken together which are longitudinally disposed between the first turbine section 16 and the first bearing 20 and radially disposed proximate the shaft 12. In an exemplary enablement, the first brush seal assembly 22 is the only seal longitudinally disposed between the first turbine section 16 and the first bearing 20 and radially disposed proximate the shaft 12. In a preferred embodiment, the bristles 24 of the first brush-seal assembly 22 provide generally one-hundred-percent of the steam-sealing capability of the first brush seal assembly 22.

Other components of the steam turbine 10 include a (typically stationary) casing 26 which is radially spaced apart from and generally circumferentially surrounds the shaft 12 and the first turbine section 16. The first bearing 20 and the first brush seal assembly 22 are attached to the casing 26. A first conduit 28 directs steam from a boiler 30 to the inlet of the first turbine section 16, and a second conduit 32 directs steam from the outlet of the first turbine section 16 back to the boiler 30 for reheating.

In a second preferred embodiment of the invention, the steam turbine 10 includes the shaft 12 and the first turbine section 16 of the first preferred embodiment. Additionally, the steam turbine 10 includes a second turbine section 34 longitudinally spaced apart from the first turbine section 16 without an intervening bearing. The second turbine section 34 has rotatable steam-turbine blades 36 fixedly attached to, and radially extending from, the shaft 12. Steam enters the second turbine section 34 at a second pressure which is different from the first pressure. Preferably, the second turbine section 34 is an intermediate-pressure turbine section wherein the steam pressure drop through the second turbine section 34 is at least generally 2,000 kPa and wherein the difference between the first pressure of the first turbine section 16 and the second pressure of the second turbine section 34 is at least generally 600 kPa. In a typical steam turbine design, the second pressure is generally 4,000 kPa, and the pressure of the steam exiting the second turbine section 34 is generally 1,000 kPa.

Further, the steam turbine 10 includes a second brush-seal assembly 38 longitudinally disposed between the first and second turbine sections 16 and 34 and radially disposed proximate the shaft 12. The second brush seal assembly 38 includes a plurality of bristles 40 having tips which preferably generally contact the shaft 12. The steam turbine 10 is devoid of any backup seal (such as, but not limited to, a labyrinth seal) to the bristles 40 of the second brush seal assembly 38. For the purpose of describing the present invention, a steam turbine is said to be devoid of any backup seal to the bristles of a brush seal assembly longitudinally disposed between two turbine sections if the steam-leakage rate between the two turbine section would at least double if all of the bristles of the brush seal assembly were removed. It is understood that the bristles 40 of the second brush seal assembly 38 may comprise one or more packets of bristles and that such packets may be located only in one area or may be longitudinally spaced apart from each other so as to be positioned at discrete sealing locations. It is further understood that the second brush-seal assembly 38 may contain, in addition to the bristles 40, other types of seals including, without limitation, labyrinth seals but only if the other types of seals are being used as primary (and not backup) seals. However, it is preferred that the bristles 40 of the second brush seal assembly 38 provide at least generally ninety-percent of the total steam-sealing capability of all seals taken together which are longitudinally disposed between the first and second turbine sections 16 and 34 and radially disposed proximate the shaft 12. In an exemplary enablement, the second brush seal assembly 38 is the only seal longitudinally disposed between the first and second turbine sections 16 and 34 and radially disposed proximate the shaft 12. In a preferred embodiment, the bristles 40 of the second brush-seal assembly 38 provide generally one-hundred-percent of the steam-sealing capability of the second brush seal assembly 38.

Other components typically found in the steam turbine 10 include a low-pressure turbine section 42, a second bearing 44, and a condenser 46. Steam typically enters the low-pressure turbine section 42 at generally 150 psia and exits the low pressure turbine section 42 at subatmospheric pressure. A third conduit 48 directs steam from the boiler 30 to the inlet of the second turbine section 34, a fourth conduit 50 directs "steam" from the outlet of the second turbine section 34 to the condenser 46, and a fifth conduit 52 returns the condensed steam from the condenser 46 back to the boiler 30. It is noted that the casing 26 (which may be a single monolithic casing or attached-together longitudinal casing segments) additionally is radially spaced apart from and generally circumferentially surrounds the second turbine section 34 and the low-pressure turbine section 42. The second bearing 44 and the second brush seal assembly 38 are attached to the casing 26. Preferably, the second bearing 44 is a tilting pad bearing.

Figure 4:
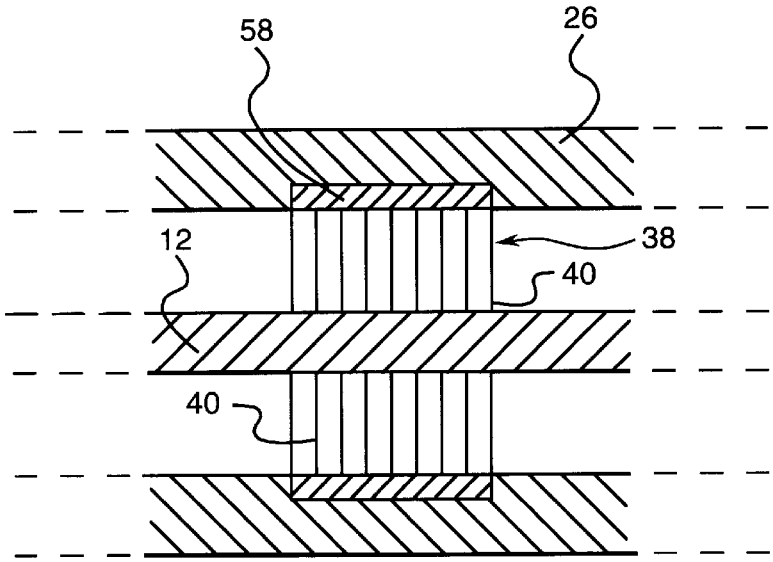
FIG. 4 is an enlarged view of a portion of the steam turbine of FIG. 1 showing the second brush seal assembly and surrounding area.
Figure 5:
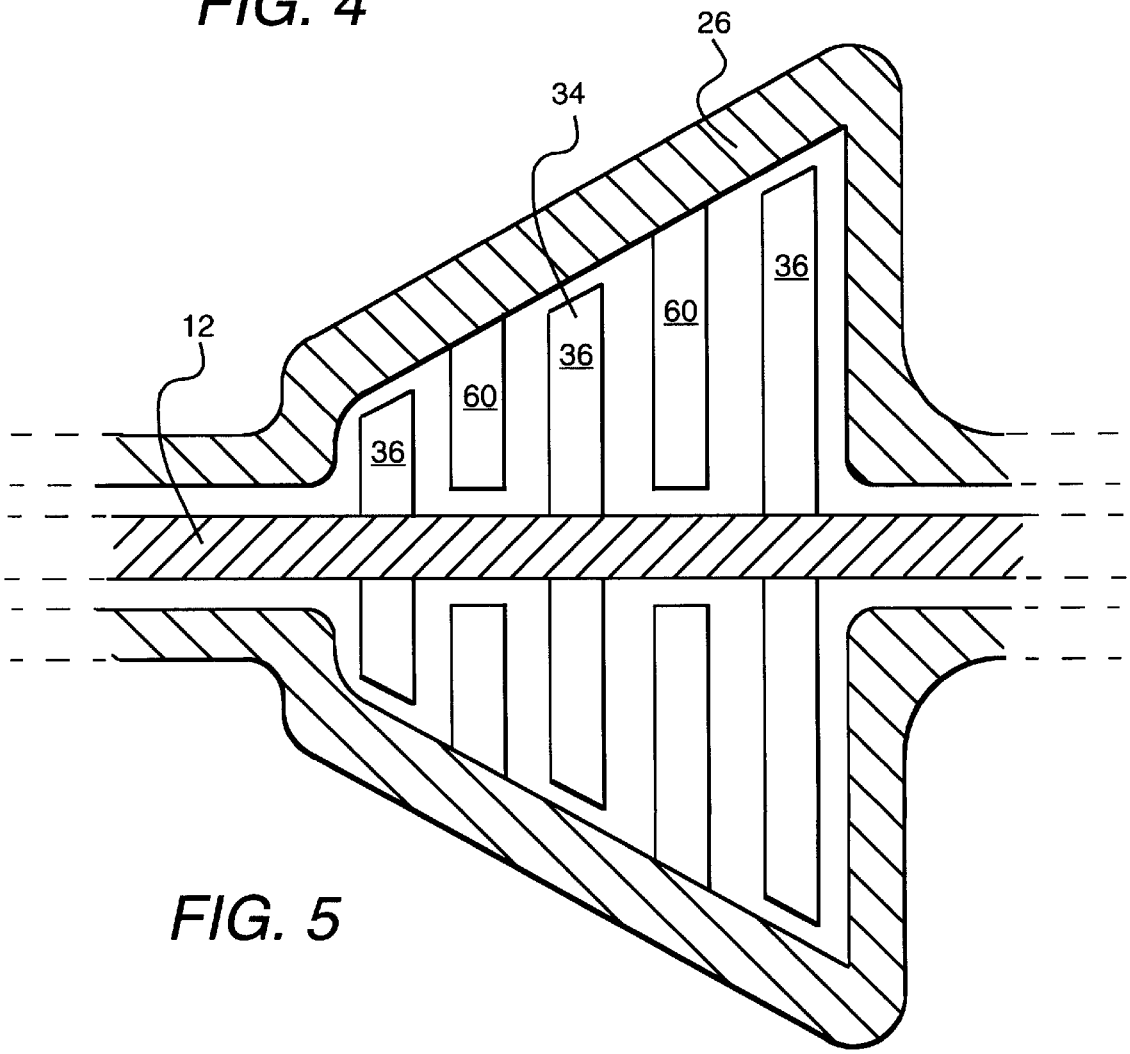
FIG. 5 is an enlarged view of a portion of the steam turbine of FIG. 1 showing the second turbine section (i.e., the intermediate-pressure turbine section) and surrounding area.

In a third preferred embodiment of the invention, the steam turbine 10 combines the components previously described for the first and second preferred embodiments. It is pointed out that FIG. 2 shows an enlarged first brush seal assembly 22 and surrounding area of the steam turbine 10. The bristles 24 each have a fixed end which is attached to a plate 54 which is itself attached to the casing 26. The bristles 24 each have a free end (i.e., a tip) which is disposed proximate (and preferably generally contacts) the shaft 12. It is also pointed out that FIG. 3 shows an enlarged first turbine section 16 and surrounding area of the steam turbine 10. It is seen that vanes 56 are attached to, and radially extend inwardly from, the casing 26. Likewise, FIG. 4 shows an enlarged second brush seal assembly 38 and surrounding area of the steam turbine 10. The bristles 40 each have a fixed end which is attached to a plate 58 which is itself attached to the casing 26. The bristles 40 each have a free end (i.e., a tip) which is disposed proximate (and preferably generally contacts) the shaft 12. Also, FIG. 5 shows an enlarged second turbine section 34 and surrounding area of the steam turbine 10. It is seen that vanes 60 are attached to, and radially extend inwardly from, the casing 26. Preferred materials for the bristles 24 and 40 include, without limitation, coated or uncoated metal (including alloy) wire bristles and ceramic wire bristles. Preferably, the steam turbine of the present invention is a large utility steam turbine or a combined cycle steam turbine which is used to power one or more generators producing a total of at least two-hundred megawatts of electricity.

The foregoing description of several preferred embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. A steam turbine comprising:

a) a steam-turbine shaft having a generally longitudinally-extending axis;

b) a first turbine section having rotatable steam-turbine blades fixedly attached to, and radially extending from, said shaft, wherein steam enters said first turbine section at a first pressure;

c) a second turbine section longitudinally spaced apart from said first turbine section without an intervening bearing and having rotatable steam-turbine blades fixedly attached to, and radially extending from, said shaft, wherein steam enters said second turbine section at a second pressure which is different from said first pressure; and d) a second brush-seal assembly longitudinally disposed between said first and second turbine sections and radially disposed proximate said shaft, wherein said second brush seal assembly includes a plurality of bristles, and wherein said steam turbine is devoid of any backup seal to said bristles of said second brush seal assembly.

2. The steam turbine of claim 1, wherein said bristles of said second brush-seal assembly provide at least generally ninety-percent of the total steam-sealing capability of all seals taken together which are longitudinally disposed between said first and second turbine sections and radially disposed proximate said shaft.

3. The steam turbine of claim 2, wherein the steam pressure drop through each of said first and second turbine sections is at least generally 2,000 kPa, and wherein the difference between said first pressure of said first turbine section and said second pressure of said second turbine section is at least generally 600 kPa.

4. The steam turbine of claim 3, wherein said second brush-seal assembly is the only seal longitudinally disposed between said first and second turbine sections and radially disposed proximate said shaft.

5. The steam turbine of claim 4, wherein said bristles of said second brush-seal assembly provide generally one-hundred-percent of the steam-sealing capability of said second brush seal assembly.

6. A steam turbine comprising:

a) a steam-turbine shaft having a generally longitudinally-extending axis;

b) a first turbine section having rotatable steam-turbine blades fixedly attached to, and radially extending from, said shaft, wherein steam enters said first turbine section at a first pressure;

c) a first bearing longitudinally spaced apart from said first turbine section and rotatably supporting said shaft;

d) a first brush-seal assembly longitudinally disposed between said first turbine section and said first bearing and radially disposed proximate said shaft, wherein said first brush seal assembly includes a plurality of bristles, and wherein said steam turbine is devoid of any backup seal to said bristles of said first brush seal assembly;

e) a second turbine section longitudinally spaced apart from said first turbine section without an intervening bearing and having rotatable steam-turbine blades fixedly attached to, and radially extending from, said shaft, wherein steam enters said second turbine section at a second pressure which is different from said first pressure; and f) a second brush-seal assembly longitudinally disposed between said first and second turbine sections and radially disposed proximate said shaft, wherein said second brush seal assembly includes a plurality of bristles, and wherein said steam turbine is devoid of any backup seal to said bristles of said second brush seal assembly.

7. The steam turbine of claim 6, wherein said bristles of said first brush-seal assembly provide at least generally ninety-percent of the total steam-sealing capability of all seals taken together which are longitudinally disposed between said first turbine section and said first bearing and radially disposed proximate said shaft.

8. The steam turbine of claim 7, wherein the steam pressure drop through said first turbine section is at least generally 2,000 kPa.

9. The steam turbine of claim 8, wherein said first brush-seal assembly is the only seal longitudinally disposed between said first turbine section and said first bearing and radially disposed proximate said shaft.

10. The steam turbine of claim 9, wherein said bristles of said first brush-seal assembly provide generally one-hundred-percent of the steam-sealing capability of said first brush seal assembly.

11. The steam turbine of claim 10, wherein said bristles of said second brush-seal assembly provide at least generally ninety-percent of the total steam-sealing capability of all seals taken together which are longitudinally disposed between said first and second turbine sections and radially disposed proximate said shaft.

12. The steam turbine of claim 11, wherein the steam pressure drop through second turbine section is at least generally 2,000 kPa.

13. The steam turbine of claim 12, wherein the difference between said first pressure of said first turbine section and said second pressure of said second turbine sections is at least generally 600 kPa.

14. The steam turbine of claim 13, wherein said second brush-seal assembly is the only seal longitudinally disposed between said first and second turbine sections and radially disposed proximate said shaft.

15. The steam turbine of claim 14, wherein said bristles of said second brush-seal assembly provide generally one-hundred-percent of the steam-sealing capability of said second brush seal assembly.

* * * * *